US009260932B2

(12) United States Patent
Weir et al.

(10) Patent No.: US 9,260,932 B2
(45) Date of Patent: Feb. 16, 2016

(54) BLOWOUT PREVENTER RAM ASSEMBLY AND METHOD OF USING SAME

(75) Inventors: James William Weir, Houston, TX (US); Eric Trevor Ensley, Cypress, TX (US)

(73) Assignee: National Oilwell Varco, L.P., Houston, TX (US)

( * ) Notice: Subject to any disclaimer, the term of this patent is extended or adjusted under 35 U.S.C. 154(b) by 288 days.

(21) Appl. No.: 13/820,580

(22) PCT Filed: Sep. 13, 2011

(86) PCT No.: PCT/US2011/051472

§ 371 (c)(1), (2), (4) Date: Mar. 4, 2013

(87) PCT Pub. No.: WO2012/037173

PCT Pub. Date: Mar. 22, 2012

(65) Prior Publication Data

US 2013/0313449 A1 Nov. 28, 2013

Related U.S. Application Data

(60) Provisional application No. 61/382,770, filed on Sep. 14, 2010.

(51) Int. Cl.
*E21B 33/06* (2006.01)

(52) U.S. Cl.
CPC ..... *E21B 33/061* (2013.01); *E21B 33/062* (2013.01); *Y10T 137/0491* (2015.04)

(58) Field of Classification Search
CPC ..... E21B 33/061–33/064
USPC ..... 251/1.1–1.3; 137/797
See application file for complete search history.

(56) References Cited

U.S. PATENT DOCUMENTS

| | | | | |
|---|---|---|---|---|
| 4,647,002 | A | 3/1987 | Crutchfield | |
| 5,025,708 | A | 6/1991 | Smith et al. | |
| 5,575,452 | A | 11/1996 | Whitby et al. | |
| 5,735,502 | A | 4/1998 | Levett et al. | |
| 5,897,094 | A | 4/1999 | Brugman et al. | |
| 5,975,484 | A | 11/1999 | Brugman et al. | |
| 6,173,770 | B1 | 1/2001 | Morrill | |
| 7,044,430 | B2 * | 5/2006 | Brugman et al. | 251/1.1 |

(Continued)

OTHER PUBLICATIONS

International Preliminary Report on Patentability and Written Opinion for PCT Patent Application No. PCT/US2011/051472 dated Mar. 19, 2013, 6 pages.

(Continued)

*Primary Examiner* — John K Fristoe, Jr.
*Assistant Examiner* — Daphne M Barry
(74) *Attorney, Agent, or Firm* — JL Salazar Law Firm, PLLC

(57) ABSTRACT

The techniques herein relate to a ram assembly for a blowout preventer for receiving a tubular of a wellbore. The ram assembly includes a ram block for engagement with the tubular, a ram shaft for selectively extending and retracting the ram block, and a ram connector for operatively connecting the ram shaft to the ram block. The ram block has at least one block groove. The ram shaft has a ram head with at least one shaft groove. The ram connector includes at least one shear connector correspondingly disposable in the block groove and the shaft groove whereby the ram shaft is releasably securable to the ram block.

25 Claims, 9 Drawing Sheets

(56) References Cited

U.S. PATENT DOCUMENTS

| | | | | |
|---|---|---|---|---|
| 7,051,989 | B2 | 5/2006 | Springett et al. | |
| 7,124,770 | B2 * | 10/2006 | Schmidt et al. | 137/68.16 |
| 7,413,019 | B2 | 8/2008 | Hemphill et al. | |
| 7,464,765 | B2 * | 12/2008 | Isaacks et al. | 166/378 |
| 7,578,349 | B2 * | 8/2009 | Sundararajan et al. | 166/363 |
| 7,832,480 | B1 * | 11/2010 | Fanguy | 166/298 |
| 8,540,017 | B2 * | 9/2013 | Ensley et al. | 166/85.4 |
| 2006/0021749 | A1 | 2/2006 | Schaeper | |
| 2006/0113501 | A1 | 6/2006 | Isaacks et al. | |
| 2008/0265188 | A1 | 10/2008 | Springett et al. | |
| 2009/0056132 | A1 | 3/2009 | Foote | |
| 2010/0155080 | A1 | 6/2010 | Carbaugh et al. | |

OTHER PUBLICATIONS

Notification of Transmittal of the International Search Report and the Written Opinion of the International Searching Authority, or the Declaration, International Search Report, and Written Opinion of the International Searching Authority, Feb. 12, 2013, PCT/US2011/051472, 11 pages.

* cited by examiner

BLOWOUT PREVENTER RAM ASSEMBLY AND METHOD OF USING SAME

BACKGROUND

1. Field

This disclosure relates generally to techniques for performing wellsite operations. More specifically, the present invention relates to techniques, such as blowout preventers (BOPs) and related devices, for controlling leaks at a wellsite.

2. Background of the Related Art

Oilfield operations are typically performed to locate and gather valuable downhole fluids. Oil rigs may be positioned at wellsites, and downhole tools, such as drilling tools, may be deployed into the ground to reach subsurface reservoirs. Once the downhole tools form a wellbore to reach a desired reservoir, casings may be cemented into place within the wellbore, and the wellbore completed to initiate production of fluids from the reservoir. Casing, pipes or other tubing may be positioned in the wellbore to enable the passage of subsurface fluids to the surface. During wellsite operations a blowout preventer (BOP) may be placed at a wellhead to control pressure from the wellbore.

Leakage of subsurface fluids may pose a threat if released from the wellbore. Equipment, such as a BOP, may be positioned about the wellbore to form a seal with and/or sever pipes therein to prevent leakage of fluid as it is brought to the surface. In some cases, the BOPs employ rams and/or ram blocks that seal and/or sever tubing from the wellbore. Some examples of ram BOPs and/or ram blocks are provided in U.S. patent application Ser. No. 12/838,701, U.S. Pat. Nos. 4,647,002, 6,173,770, 5,025,708, 7,051,989, 5,575,452, 6,374,925, 2008/0265188, 5,735,502, 5,897,094, 7,234,530 and 2009/0056132. Some BOPs have bonnets as described, for example, in U.S. Pat. Nos. 5,897,094 and 7,044,430.

Despite the development of techniques relating to rams and/or ram blocks, there remains a need to provide advanced blowout preventer techniques. The present invention is directed to fulfilling these needs in the art.

SUMMARY

In at least one aspect, the disclosure relates to a ram assembly for a blowout preventer for receiving a tubular of a wellbore. The ram assembly has a ram block therein for engagement with the tubular, a ram shaft for selectively extending and retracting the ram block and a ram connector for operatively connecting the ram shaft to the ram block. The ram block has at least one block groove. The ram shaft has a ram head with at least one shaft groove. The ram connector has at least one shear connector correspondingly disposable in the block groove and the shaft groove whereby the ram shaft is releasably securable to the ram block.

The ram connector may be a rod receivable in the block groove and the shaft groove. Optionally, the ram connector may have an elliptical cross-section and/or a rectangular cross-section. The ram connector may have a handle so that an operator, a remotely operated vehicle and/or a replacement system may grip and remove the ram connector from the ram block and/or the ram shaft. The ram connector may also have a lock which may couple the ram connector to the ram block and/or the ram shaft. Optionally, the ram connector extends through the ram block, the ram head, and/or a space between the ram head and the ram block. To receive the ram connector, the block groove and the shaft groove may define a connection angle. Optionally, the shaft groove may be on a horizontal or vertical surface of the ram head. The ram block may have a receptacle for receiving the ram head of the ram shaft. The ram assembly may have a seal disposable about the ram block for sealing engagement with the tubular. The ram assembly may have a blade disposable about the ram block for severing engagement with the tubular. In another aspect, the disclosure relates to a blowout preventer for receiving a tubular of a wellbore. The blowout preventer has a body and at least one ram assembly. The body has a hole therethrough for receiving the tubular and at least one channel therethrough. Each ram assembly is positionable in a corresponding channel. The ram assembly may have a ram block for engagement with the tubular, a ram shaft for selectively extending and retracting the ram block, a ram connector for operatively connecting the ram shaft to the ram block and at least one actuator for selectively activating the ram assembly. The ram block has at least one block groove. The ram shaft has a ram head with at least one shaft groove. The ram connector includes at least one shear connector correspondingly disposable in the block groove and the shaft groove whereby the ram shaft is releasably securable to the ram block. The blowout preventer may further have a controller and/or a remote operated vehicle.

Finally, in yet another aspect, the disclosure relates to a method of assembling a ram assembly for a blowout preventer for receiving a tubular of a wellbore. The method involves providing a ram assembly having a ram block for engagement with the tubular, a ram shaft for selectively extending and retracting the ram block, a ram connector for operatively connecting the ram shaft to the ram block and a ram connector for operatively connecting the ram shaft to the ram block. The ram block has at least one block groove and a ram head with at least one shaft groove. The ram connector includes at least one shear connector. The method also involves releasably securing the ram shaft to the ram block by correspondingly disposing the shear connector in the block groove and the shaft groove.

The method may also involve disposing the ram head of the ram shaft in a receptacle of the ram block. The step of releasably securing may involve disposing the ram connector in a space between the ram shaft and the ram block, or through one of the ram shaft, the ram block or combinations thereof.

BRIEF DESCRIPTION DRAWINGS

So that the above recited features and advantages of the present disclosure can be understood in detail, a more particular description of the techniques, briefly summarized above, may be had by reference to the embodiments thereof that are illustrated in the appended drawings. It is to be noted, however, that the appended drawings illustrate only typical embodiments of the disclosure and are, therefore, not to be considered limiting of its scope, for the techniques may relate to other equally effective embodiments. The figures are not necessarily to scale and certain features, and certain views of the figures may be shown exaggerated in scale or in schematic in the interest of clarity and conciseness.

DETAILED DESCRIPTION

The description that follows includes exemplary apparatuses, systems, methods, techniques, and instruction sequences that embody techniques of the present subject matter. However, it is understood that the described embodiments may be practiced without these specific details.

The techniques herein relate to devices, such as ram connectors, used with ram blocks of a blowout preventer. These techniques may be used to provide more efficient removal/installation of ram blocks, and/or to provide a robust connection of the ram blocks to the blowout preventer. These techniques may involve one or more of the following, among others: a robust connection between the ram shaft and the ram block, adaptability to wellsite equipment (e.g., various pipe diameters), enhanced interchangeability, performance under deflection and/or wellsite equipment failures, distribution and/or absorption of loads, reduced space requirements, enhanced manufacturing capabilities (e.g., wider tolerances), balanced pressures, and increased capacity (e.g., load, pressure, etc.)

Figure 1:
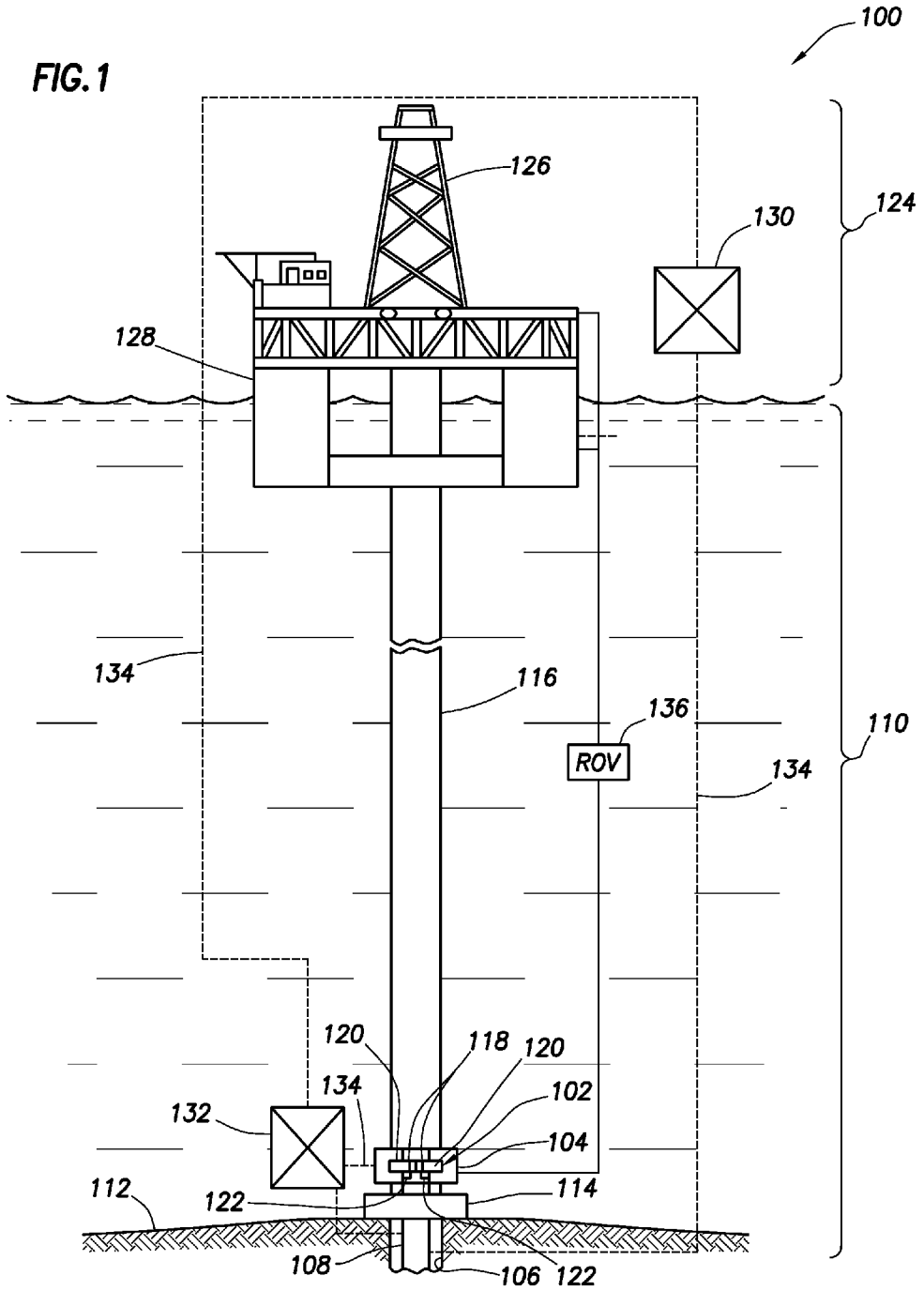
FIG. 1 is a schematic view of an offshore wellsite provided with a blowout preventer (BOP) having a ram block assembly with a ram connector.

FIG. 1 depicts an offshore wellsite 100 having a ram block assembly 102 in a blowout preventer (BOP) 104. The ram block assembly 102 may be configured to seal a wellbore 106, and/or sever a pipe 108 in the wellbore 106. The BOP 104 may be part of a subsea system 110 positioned on a floor 112 of the sea. The subsea system 110 may also comprise the pipe (or tubular) 108 extending from the wellbore 106, a wellhead 114 about the wellbore 106, a conduit 116 extending from the wellbore 106 and other subsea devices, such as a stripper and a conveyance delivery system (not shown).

The ram block assembly 102 may have a ram block 118, a ram shaft 120 and a ram connector 122 (shown schematically). The ram connector 122 may be configured to allow for the quick removal and installation of the ram block 118 from the ram shaft 120, as will be discussed in more detail below. A remotely operated vehicle (ROV) 136 may be deployed from the surface to access the ram block assembly 102 in the BOP 104 to complete the removal and/or installation process.

While the offshore wellsite 100 is depicted as a subsea operation, it will be appreciated that the wellsite 100 may be land or water based, and the ram block assembly 102 may be used in any wellsite environment. The pipe 108 may be any suitable tubular and/or conveyance for running tools into the wellbore 106 such as a drill string, a casing, a production tubing, a tool joint, a bottom hole assembly, a wireline, a coiled tubing, and the like.

A surface system 124 may be used to facilitate operations at the offshore wellsite 100. The surface system 124 may include a rig 126, a platform 128 (or vessel) and a surface controller 130. Further, there may be one or more subsea controllers 132. While the surface controller 130 is shown as part of the surface system 124 at a surface location, and the subsea controller 132 is shown as part of the subsea system 110 in a subsea location, it will be appreciated that one or more controllers 130, 132 may be located at various locations to control the surface and/or subsea systems.

To operate the ram block assembly 102 and/or other devices associated with the wellsite 100, the surface controller 130 and/or the subsea controller 132 may be placed in communication therewith. The surface controller 130, the subsea controller 132, and/or any devices at the wellsite 100 may communicate via one or more communication links 134. The communication links 134 may be any suitable communication system and/or device, such as hydraulic lines, pneumatic lines, wiring, fiber optics, telemetry, acoustics, wireless communication, any combination thereof, and the like. The ram block assembly 102, the BOP 104, and/or other devices at the wellsite 100 may be automatically, manually, and/or selectively operated via the controllers 130 and/or 132.

Figure 2:
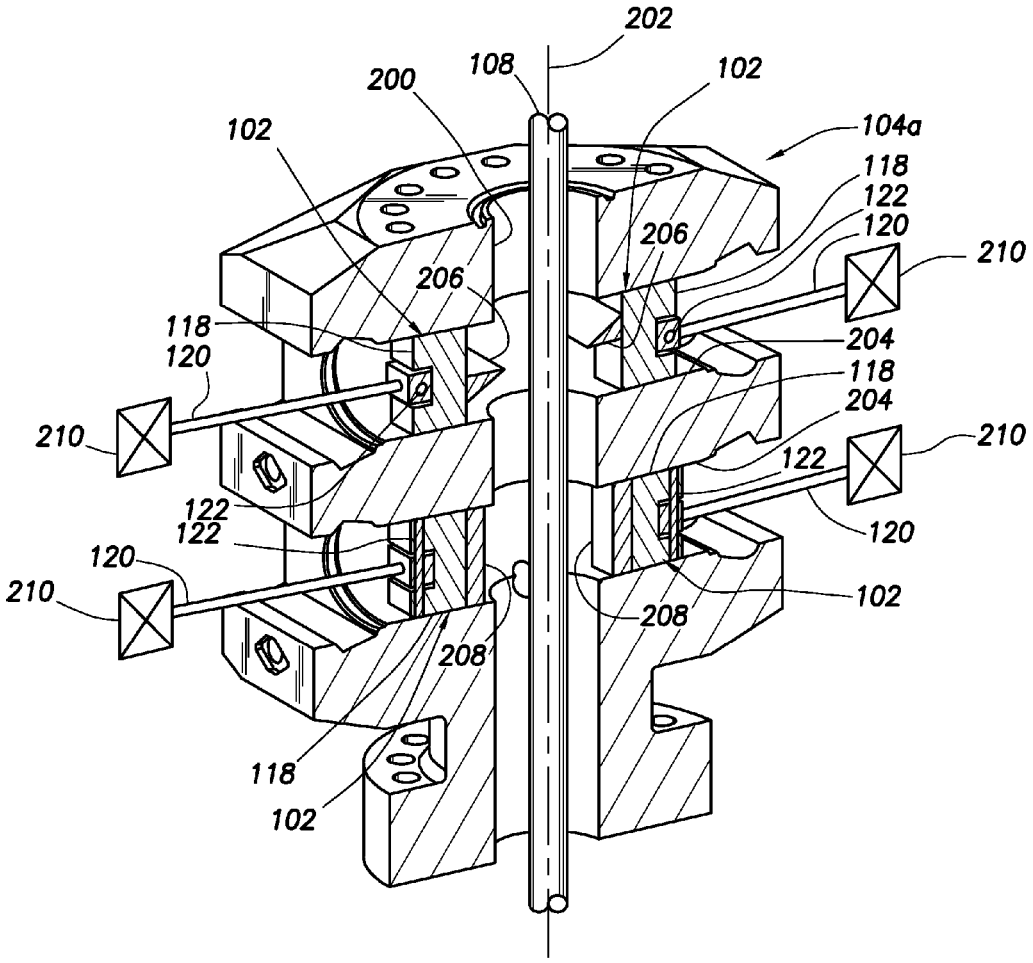
FIG. 2 is a schematic view, partially in cross-section, of a BOP with ram block assemblies therein.
Figure 3:
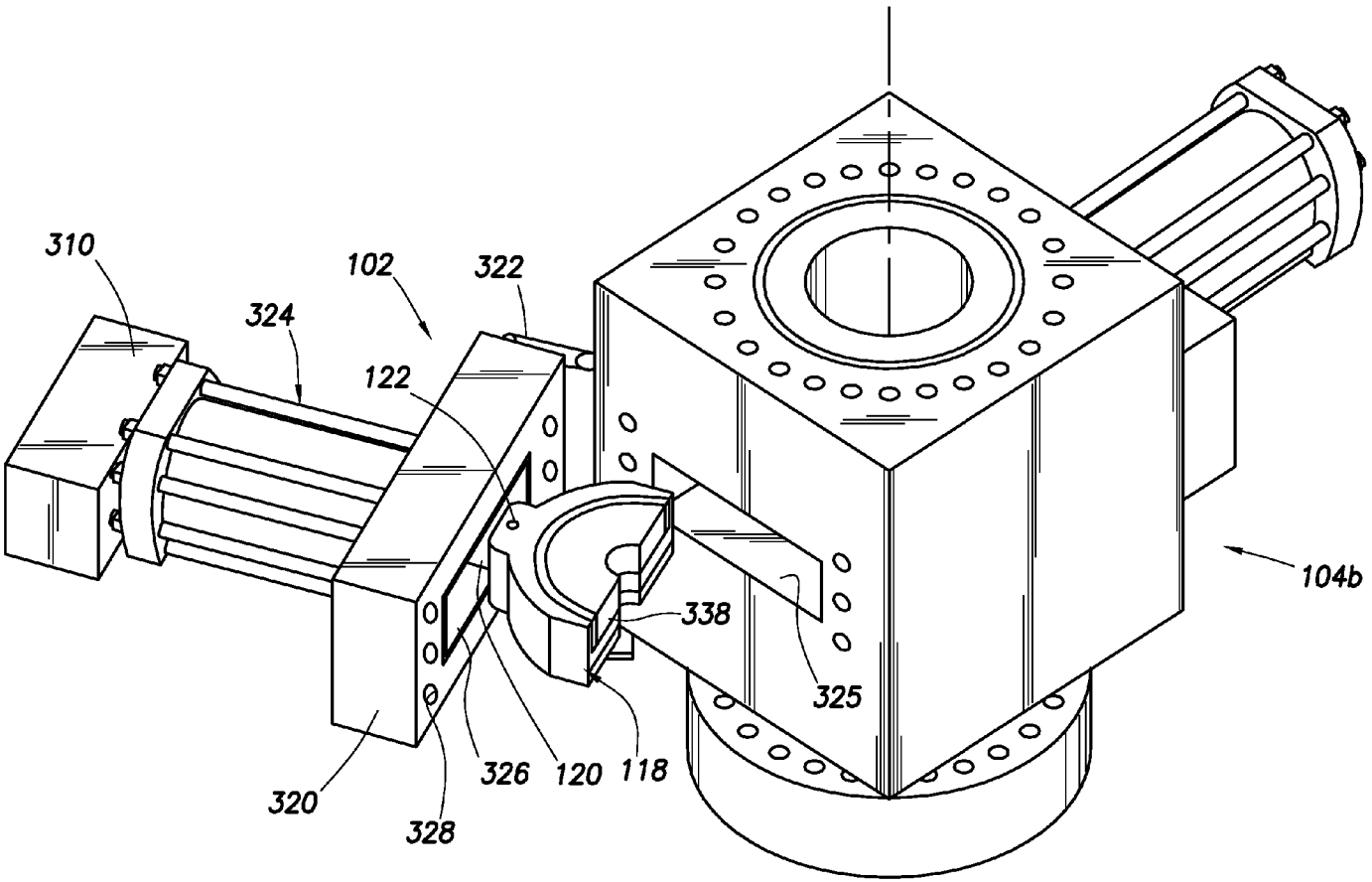
FIG. 3 is a schematic perspective view of another BOP with a bonnet in an open position for accessing a ram block assembly therein.

FIGS. 2 and 3 show schematic views of BOPs 104*a*,104*b* usable as the BOP 104 of FIG. 1. While the BOPs 104*a*,104*b* are depicted as having specific configurations, it will be appreciated that the BOP used with the ram assembly 102 and ram connector 122 provided herein may be any conventional BOP that provides access thereto. Examples of BOPs that may be used are described in U.S. Pat. Nos. 5,735,502, 5,897,094 and 7,044,430. The selected BOP may have a variety of shapes, and be provided with other devices, such as sensors (not shown).

The BOP 104*a* of FIG. 2 has a hole 200 through a central axis 202 of the BOP 104*a*. The hole 200 may be for receiving the pipe 108. The BOP 104*a* has multiple ram block assemblies 102. The BOP 104*a* may have one or more channels 204 for receiving the ram block assemblies 102. As shown, there are two channels 204, each with a ram block assembly 102 therein. The channels 204 may be configured to guide the ram blocks 118 radially toward and away from the pipe 108. The BOP 104*a* may allow the pipe 108 to pass through the BOP 104*a* during normal operation, such as run in, drilling, logging, and the like. In the event of an upset, or a pressure surge, the BOP 104*a* may sever the pipe 108 and/or seal the hole 200 in order to prevent fluids from being released from the wellbore 106.

The BOP 104*a*, as shown, has one ram block assembly 102 with blades 206 for severing the pipe 108, and one ram block assembly 102 with a seal 208 for sealing the hole 200 and/or the annulus around the pipe 108. Each of the ram block assemblies 102 may have the ram blocks 118, the ram shaft 120 and the ram connector 122. The ram shaft 120 may couple to an actuator 210 (shown schematically). The actuator 210 may be configured to move the ram shaft 120 and the ram blocks 118 between an operating position, as shown in FIG. 2, and an actuated position wherein the ram blocks 118 have severed the pipe 108 and/or sealed the hole 200. The actuator 210 may be any suitable actuator such as a hydraulic actuator, a pneumatic actuator, a servo, and the like.

The ram block assembly 102 of FIG. 3 includes the ram block 118, the ram shaft 120, and the ram connector 122 as previously described. The ram block 118 shown in FIG. 3, is configured to support a seal 338. The BOP 104*b* may have a bonnet 320 (or door) for accessing the ram block assembly 102. The bonnet 320, as shown, has a hinge 322, a ram cylinder 324, an alignment channel 326, and a connection system 328. The hinge 322 may be for pivotally mounting the bonnet 320 to the BOP 104*b*. The ram cylinder 324 may provide stroke, or length, for the ram shaft 120 between the ram block 118 and an actuator 310 (or cylinder). The alignment channel 326 may be configured to align with one or more channels 325 of the BOP 104*b* when the bonnet 320 is closed. The alignment channel 326 may be configured to house the ram block assembly 102, or a portion thereof, when the ram block assembly 102 is in the operating position.

The connection system 328, as shown, may be any suitable device, or system for sealing and coupling the bonnet 320 to the BOP 104*b*, and thereby aligning the ram block 118 with the alignment channel 326. Although, the bonnet 320, is shown, as a hinged bonnet, it should be appreciated that any suitable bonnet or door may be used to allow access to the ram blocks 118, and/or the ram connector 122. When the bonnet 320 is open, the ram connector 122 may be accessed in order to remove and/or replace the ram block 118.

The ram block 118 may be configured to couple to the ram shaft 120 with the ram connector 122. The ram block 118 may be any suitable ram block for supporting the blade 206 and/or the seal 338, so long as the ram block 118 is configured to receive the ram connector 122. The ram shaft 120 may be configured to couple to the actuator 310 in order to move the ram block 118. The ram shaft 120 may be any suitable ram shaft for moving the ram block 118.

The ram connector 122 may be a removable shear connection configured to couple the ram shaft 120 to the ram block 118 (as will be discussed in more detail below). To uncouple the ram block 118 from the ram shaft 120, an operator, ROV 136 (FIG. 1), and/or a replacement system may grip the ram connector 122 and remove it from the ram block 118 and/or the ram shaft 120. When the ram connector 122 is removed, the shear connection between the ram block 118 and the ram shaft 120 is lost and the ram block 118 may be disconnected (or separated) from the ram shaft 120.

The ram connector 122 may allow for a robust connection between the ram block 118 and the ram shaft 120. The connection may not require the ram block 118 to be moved perpendicular to the ram shaft 120 in order to disconnect. This may allow a portion of the ram block 118 to be located within the bonnet 320 while the ram connector 122 is removed. This may allow the ram shaft 120 to be shorter than traditional ram shafts, thereby saving space and money. The ram connector 122 may have a number of configurations so long as the ram connector 122 is configured to be a removable shear connection between the ram block 118 and the ram shaft 120.

Figure 4A:
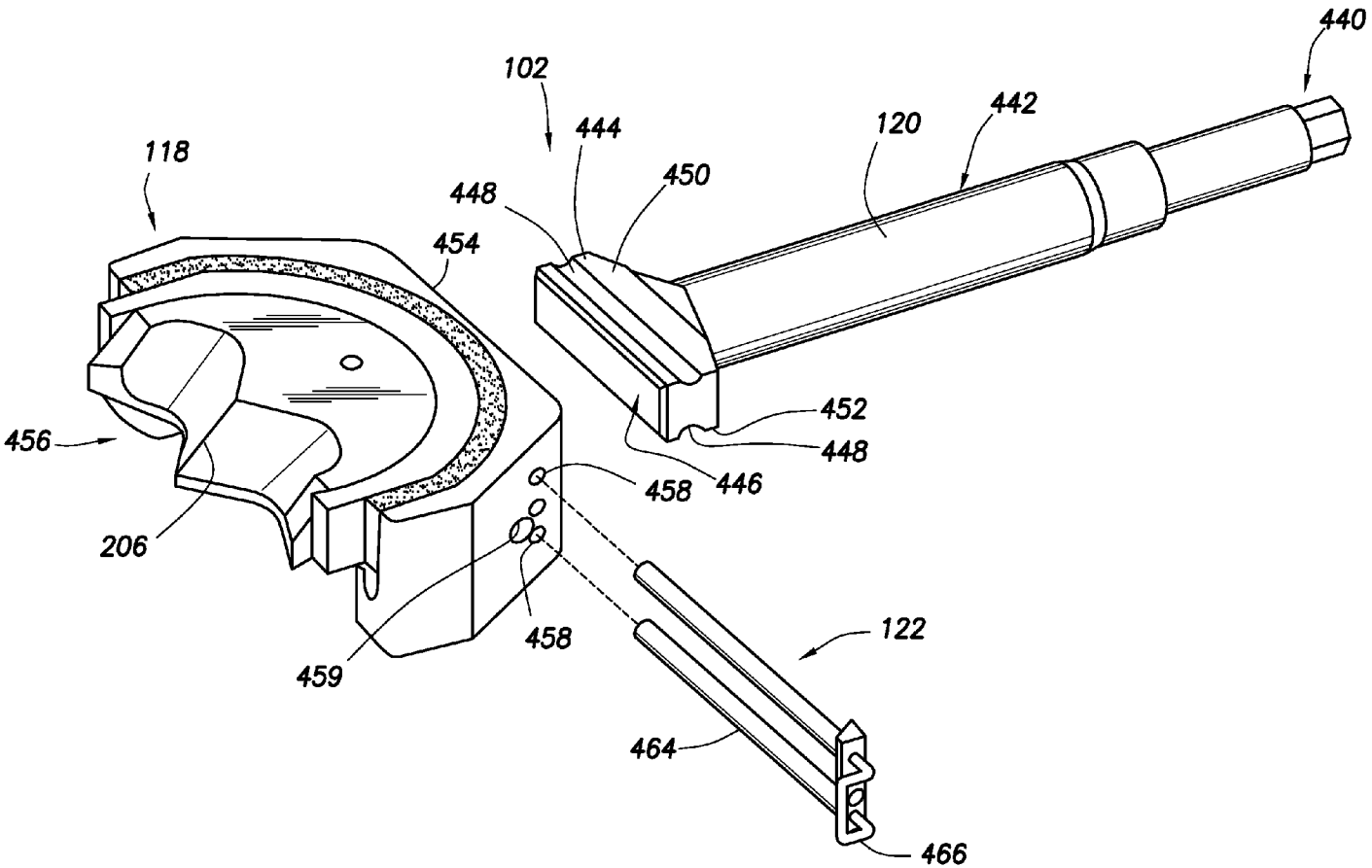
FIGS. 4A-4C are various exploded views of a ram block assembly with a ram connector.
Figure 4B:
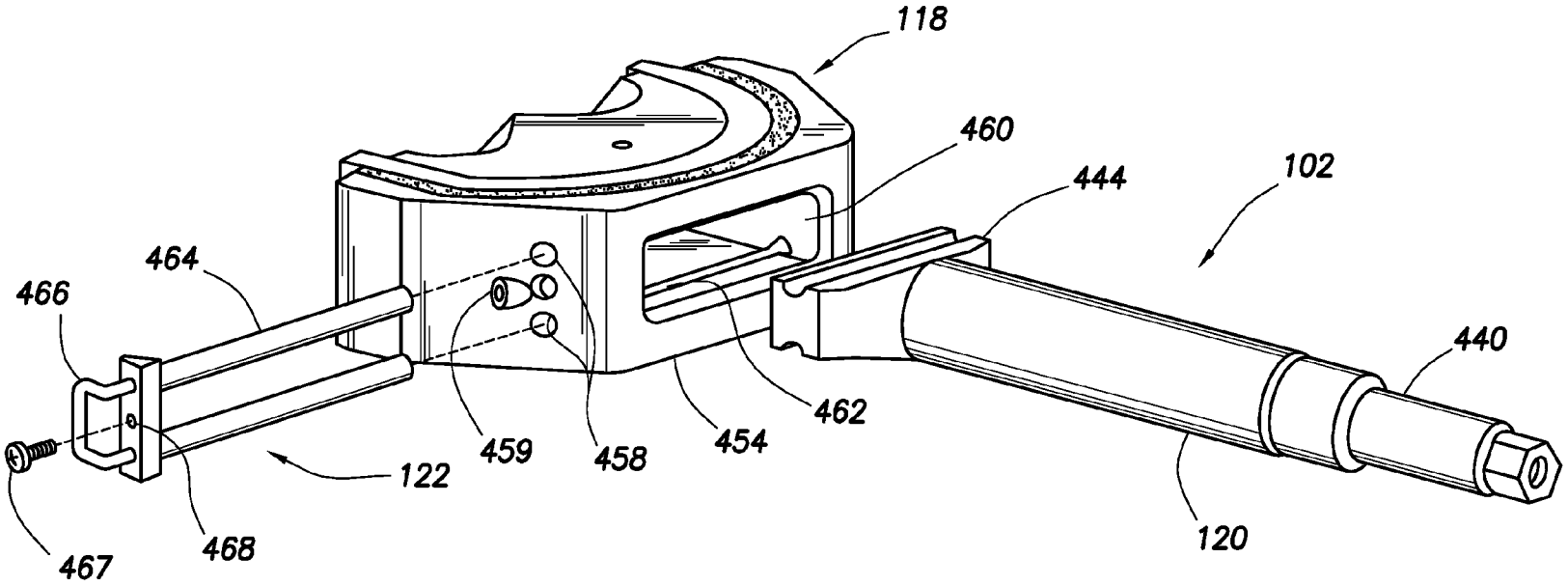
Figure 4C:
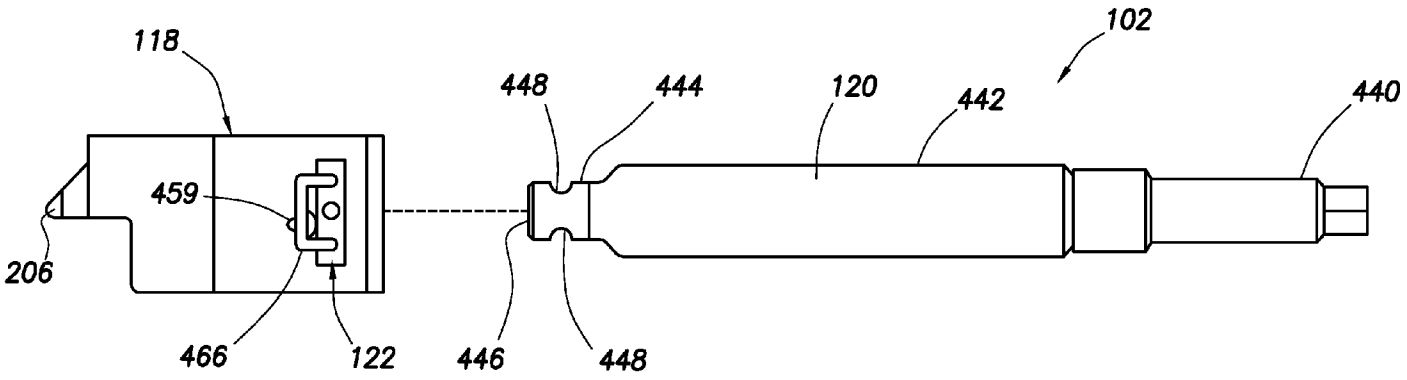

FIGS. 4A-4C depict various exploded views of the ram block assembly 102. The ram block assembly 102 has the ram block 118, the blade 206, the ram shaft 120 and the ram connector 122. The ram shaft 120 may have an actuator portion 440, a shaft portion 442 and a shaft connector 444. The actuator portion 440 of the ram shaft 120 may be configured to couple to the actuator 210 (as shown in FIG. 2). The shaft portion 442 may be any device suitable for moving the ram blocks 118 between the operating position and the engaged position. As shown, the shaft 442 is a cylinder.

The shaft connector 444 may be any suitable device capable of forming a shear connection with the ram connector 122. As shown, the shaft connector 444 may be a shaped head 446 having one or more shaft grooves 448 for receiving a portion of the ram connector 122. As shown, the one or more shaft grooves 448 are two semi-circular grooves on a top 450 and a bottom 452 of the shaped head 446. The ram connector 122 may be configured to rest partially within the semi-circular grooves in a connected position, thereby preventing the ram shaft 120 from uncoupling from the ram block 118. Having one or more shaft grooves 448 extend along a length of the shaped head 446 may further prevent pivoting between the ram shaft 120 and the ram blocks 118 during operation. Although the shaft connector 444 is shown as having the two semi-circular grooves on the top 450 and the bottom 452 of the shaped head 446, any suitable design for creating a shear connection between the ram connector 122 and the ram shaft 120 may be used. For example, the one or more shaft grooves 448 may extend from the top 450 to the bottom 452 of the shaped head 446, the one or more shaft grooves 448 may be holes, apertures, square, hexagonal, polygonal, triangular, and the like.

The ram blocks 118 may have a tool receiving end 454 and a ram connector end 456. The tool receiving end 454 may be for receiving the blade 206, and/or the seal 208 (as shown in FIG. 2). The ram connector end 456 may be any suitable device for forming a shear connection with the ram connector 122, and thereby the ram shaft 120. As shown in FIG. 4A, the ram connector end 456 may have one or more apertures 458 and a ram shaft receiving portion 460 (or receptacle) as shown in FIG. 4B. The one or more apertures 458 may be located on the outer surface of the ram block 118. The one or more apertures 458 may be configured to receive the ram connector 122 into the ram block 118. The apertures 458 may allow the ram connector 122 to pass through the outer surface of the ram block 118, and into the ram shaft receiving portion 460. One or more additional holes 459 may be provided for connecting portions of the ram block 118.

The ram shaft receiving portion 460, as shown in FIG. 4B, may be specifically shaped to receive the shaped head 446 of the shaft connector 444. The ram receiving portion 460 may further have one or more block grooves 462. The one or more block grooves 462 may be configured to substantially mirror the one or more shaft grooves 448 on the shaped head 446. As shown in FIG. 4B, the one or more block grooves 462 may be any suitable shape, or may not be present at all. If the one or more block grooves 462 are not present, the one or more apertures 458 may extend partially, or wholly, through the other side of the ram block 118 in order to provide stability.

The ram connector 122 may be any suitable, removable device for forming a shear connection between the ram block 118 and the ram shaft 120. The ram connector 122 as shown, has one or more shear connectors 464 and a handle 466. The shear connector(s) 464, as shown, are two cylinders configured to pass through the apertures 458 and into a space formed by the one or more shaft grooves 448 and the one or more block grooves 462. Although the shear connectors 464 are shown as two cylinders, the shear connectors 464 may be any suitable shaped device for being received by the ram blocks 118 and the ram shaft 120. Further, there may be any suitable number of shear connectors 464.

The handle 466, as shown in FIGS. 4A-4C, may be an extension that the operator, the ROV 136 (FIG. 1) and/or a replacement system may grip. The handle 466 may be any suitable shape that allows for the gripping and removal of the ram connector 122 from the ram block 118 and/or the ram shaft 120.

The ram connector 122 may lock to the ram block 118 and/or the ram shaft 120 using any suitable method. For example, a lock 467, such as a bolt, may couple to the ram block 118 through a handle aperture 468, as shown in FIG. 4B.

Figure 5A:
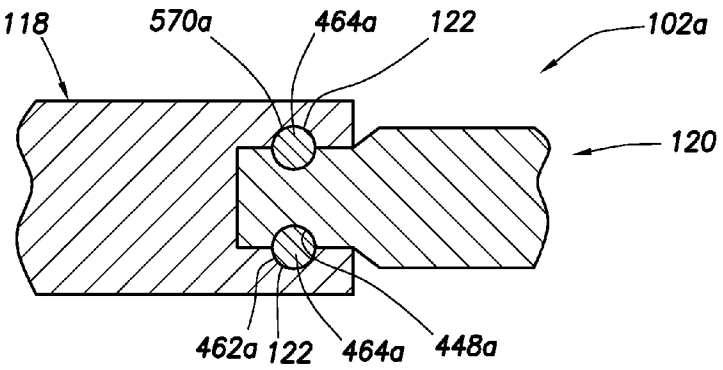
FIGS. 5A-5B are vertical cross-sectional views of a portion of a ram block assembly with various ram connectors.
Figure 5B:
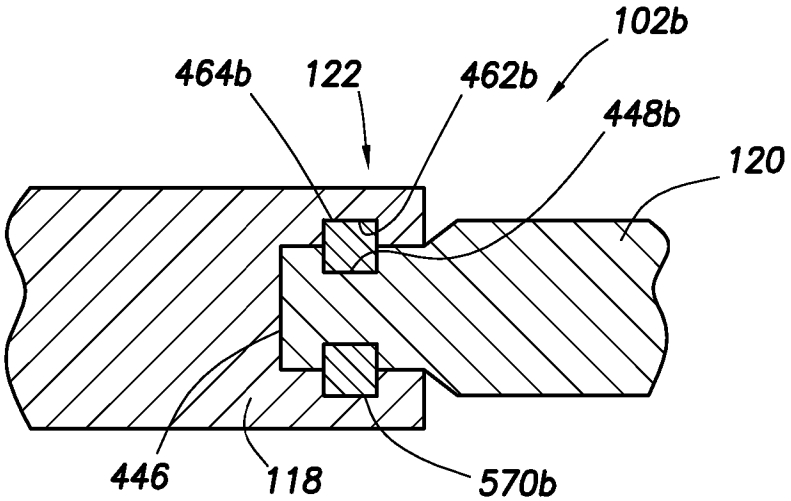

FIGS. 5A and 5B depict schematic, vertical cross-sectional views of a portion of a ram block assembly 102*a,b* usable as the ram block assembly 102 of FIG. 1. In each of these figures, the ram block assembly 102*a,b* has the ram blocks 118 with the ram shaft 120 and the ram connector 122 in a connected position. In the position shown, any movement (or force) experienced by the ram shaft 120 and/or the ram blocks 118 may be transferred through the ram connector 122. Although, the ram connector 122 is shown as coupling the ram block 118 to the ram shaft 120 along a wide axis of the ram block 118, it should be appreciated that the ram connector 122 may extend from the top to the bottom of the ram block 118 (as shown schematically in FIG. 2).

The ram block assemblies 102*a,b* may be the same as the ram block assembly 102 previously described herein. The ram block assemblies 102*a,b* of FIGS. 5A,5B have a shear connector 464*a,b*, one or more shaft grooves 448*a,b* and one or more block grooves 462*a,b* having elliptical and square cross-sections, respectively. Each of the shear connectors 464*a,b* of the ram connector 122 is located in corresponding space(s) 570*a,b* created by the one or more shaft grooves 448*a,b* of the ram shaft 120, and the one or more block grooves 462*a,b* of the ram block 118. The ram connector 122 forms the shear connection with an elliptical and square cross section, and the space(s) 570*a,b* formed by the one or more shaft grooves 448*a,b* and the one or more block grooves 462*a,b* are elliptical and square, respectively.

Figure 6A:
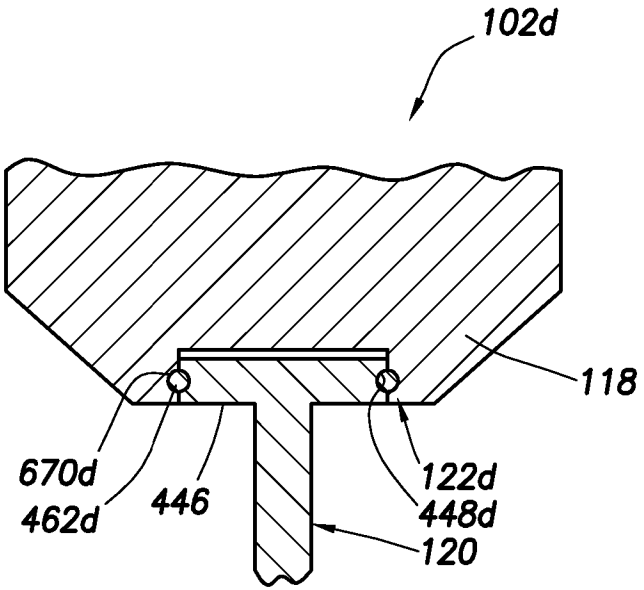
FIGS. 6A-6C are horizontal cross-sectional views of a portion of a ram block assembly with various ram connectors.
Figure 6C:
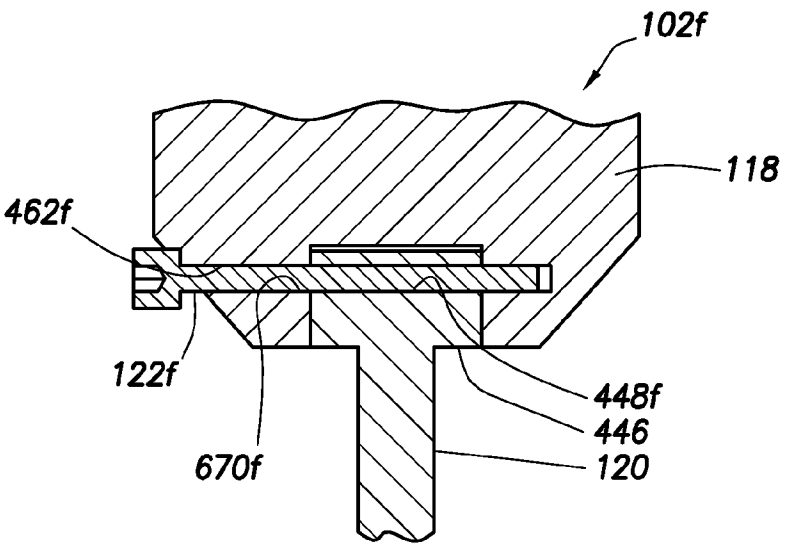
Figure 6B:
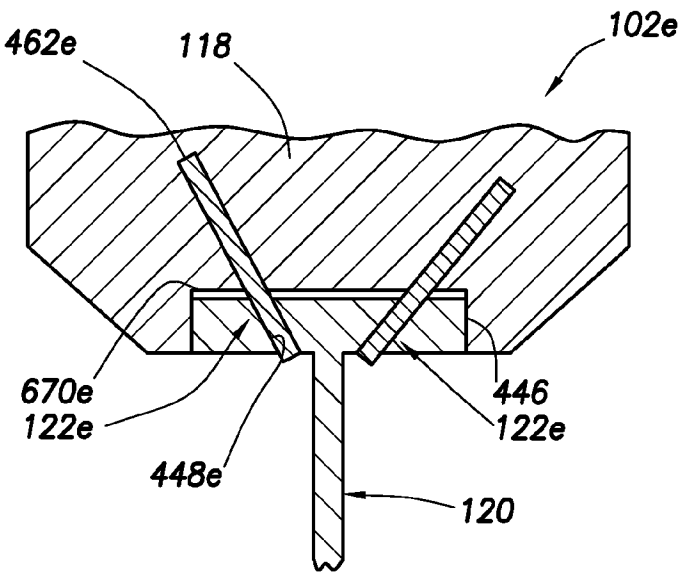

FIGS. 6A-6C are schematic, horizontal cross-sectional views of a portion of ram block assemblies 102*d-f* usable as the ram block assembly 102. Each of the ram block assemblies 102*d-f* have various ram connectors 122*d-f* usable as the ram connector 122 for forming a shear connection between the ram shaft 120 and the ram block 118.

In the version of FIG. 6A, the ram connector 122*d* is positionable vertically through the ram block assembly 102*d*. The ram connector 122*d* may extend from the top of the ram block 118 toward the bottom of the ram block 118 in corresponding space(s) 670*d* created between one or more shaft grooves 448*d* of the ram shaft 120*d* and one or more block grooves 462*d* of the ram block 118. The shaft grooves 448*d* are positioned along opposite lateral sides of the shaped head 446 of the ram shaft 120. The corresponding block grooves 462*d* are positioned along the ram block 118 adjacent to the shaft grooves 448*d*. The grooves 462*d*,448*d* are positioned to receive the ram connector 122*d* therethrough.

In the version of FIG. 6B, the ram connector 122*e* may extend from the ram shaft 120 into the ram block 118 in a radial manner. Shaft grooves 448*e* are positioned in the shaped head 446 of the ram shaft 120 and corresponding block grooves 462*e* are positioned in the ram block 118 for receiving the ram connector 122*e*. With the ram connector 122*e* extending radially through the ram shaft 120, corresponding space(s) 670*e*, and into the ram block 118, a shear connection is formed by the angle of the ram connector 122*e*. Although, the ram connector 122*e* is shown extending radially away from the ram shaft 120, it may be formed in any suitable direction.

In the version of FIG. 6C, the ram connector 122*f* may extend through the ram block 118, corresponding space(s) 670*f*, and the ram shaft 120. Shaft grooves 448*f* are positioned in the shaped head 446 of the ram shaft 120 and corresponding block grooves 462*f* are positioned in the ram block 118 for receiving the ram connector 122*f*. With the ram connector 122*f* extending through the ram block 118 and the ram shaft 120, a shear connection is formed therethrough. Although, the ram connector 122*f* is shown extending horizontally through the ram block 118 and ram shaft 120, it may be formed in any suitable direction.

Figure 7:
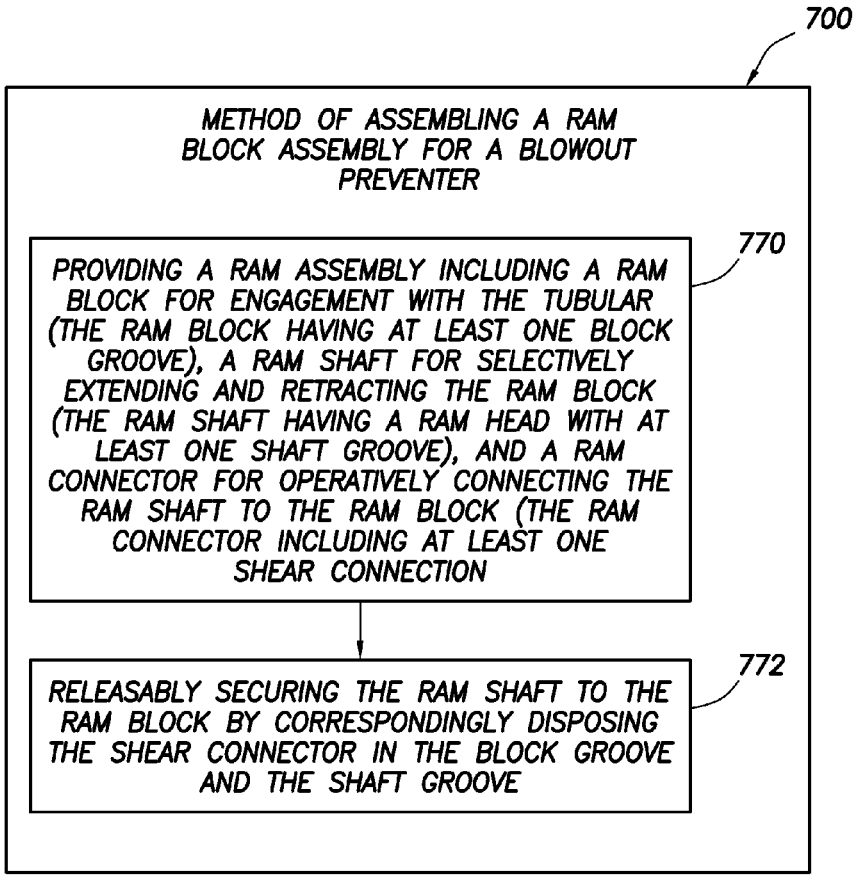
FIG. 7 is a flow chart depicting a method of assembling a ram block assembly of a blowout preventer.

FIG. 7 is a flow chart depicting a method 700 of assembling a ram block assembly for a blowout preventer. The method involves providing (770) a ram assembly including a ram block for engagement with the tubular (the ram block having at least one block groove), a ram shaft for selectively extending and retracting the ram block (the ram shaft having a ram head with at least one shaft groove), and a ram connector for operatively connecting the ram shaft to the ram block (the ram connector including at least one shear connector). The method further involving releasably securing (772) the ram shaft to the ram block by correspondingly disposing the shear connector in the block groove and the shaft groove.

The steps of the method may be performed in any order, and repeated as desired.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the invention may also be configured to perform the described functions (via appropriate hardware/software) solely on site and/or remotely controlled via an extended communication (e.g., wireless, internet, satellite, etc.) network.

While the embodiments are described with reference to various implementations and exploitations, it will be understood that these embodiments are illustrative and that the scope of the inventive subject matter is not limited to them. Many variations, modifications, additions, and improvements are possible. For example, one or more BOPs with various combinations of one or more shear connections between the ram block and the ram shaft may be used.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A ram assembly for a blowout preventer for receiving a tubular of a wellbore, comprising:

a ram block disposable through the blowout preventer and positionable in sealing engagement about the tubular, the ram block having a receptacle and at least one block groove;

a ram shaft for selectively extending and retracting the ram block, the ram shaft having a ram head receivable in the receptacle, the ram head having at least one shaft groove corresponding to the at least one block groove;

a ram connector for operatively connecting the ram head to the ram block in the receptacle, the ram connector comprising at least one shear connector disposable through a surface of the ram block and the receptacle, the ram connector correspondingly receivable in the at least one block groove and the at least one shaft groove whereby the ram shaft is releasably securable to the ram block.

2. The ram assembly of claim 1, wherein the ram connector comprises a handle.

3. The ram assembly of claim 1, wherein the ram connector comprises a lock.

4. The ram assembly of claim 1, wherein the at least one shaft groove is on at least one horizontal surface of the ram head.

5. The ram assembly of claim 1, wherein the at least one shaft groove is on at least one vertical surface of the ram head.

6. The ram assembly of claim 1, wherein the ram connector extends through a space between the ram head and the ram block.

7. The ram assembly of claim 1, wherein the at least one block groove and the at least one shaft groove define a connection angle for receiving the ram connector.

8. The ram assembly of claim 1, wherein the ram connector is a rod receivable in the at least one block groove and the at least one shaft groove.

9. The ram assembly of claim 1, wherein the ram connector has one of an elliptical cross-section, a rectangular cross-section and combinations thereof.

10. The ram assembly of claim 1, further comprising a seal disposable about the ram block for sealing engagement with the tubular.

11. The ram assembly of claim 1, further comprising a blade disposable about the ram block for severing engagement with the tubular.

12. A method of assembling a ram assembly for receiving a blowout preventer for a tubular of a wellbore, comprising:

providing a ram assembly as in claim 1; and releasably securing the ram shaft to the ram block by correspondingly disposing the at least one shear connector in the at least one block groove and the at least one shaft groove.

13. The method of claim 12, further comprising disposing the ram head of the ram shaft in a receptacle of the ram block.

14. The method of claim 12, wherein the step of releasably securing comprises disposing the ram connector in a space between the ram shaft and the ram block.

15. The method of claim 12, wherein the step of releasably securing comprises disposing the ram connector through one of the ram shaft, the ram block and combinations thereof.

16. The ram assembly of claim 1, wherein the ram block has an engagement end and a shaft end, the engagement end positionable about the tubular, the shaft end having the receptacle extending therein.

17. The ram assembly of claim 1, wherein a portion of the at least one block groove extends through an outer surface of the ram block and into the receptacle.

18. The ram assembly of claim 1, wherein the at least one block groove extends into a surface of the ram block to receive a portion of the at least one connector, wherein the at least one shaft groove extends into a surface of the ram head to receive another portion of the at least one connector.

19. The ram assembly of claim 18, wherein an end of the at least one block groove is positionable adjacent an end of the at least one receptacle groove.

20. The ram assembly of claim 18, wherein at least a portion of a length of the at least one block groove is positionable adjacent at least a portion of a length of the at least one receptacle groove.

21. The ram assembly of claim 18, wherein the at least one receptacle groove extends through an outer surface of the ram block.

22. The ram assembly of claim 18, wherein the at least one receptacle groove extends through a surface of the ram block within the receptacle.

23. A blowout preventer for receiving a tubular of a wellbore, comprising:

a body having a hole therethrough for receiving the tubular and at least one channel therethrough;

at least one ram assembly, each of the at least one ram assembly positionable in a corresponding at least one channel, the at least one ram assembly comprising:

a ram block disposable through the blowout preventer and positionable in sealing engagement about the tubular, the ram block having a receptacle and at least one block groove;

a ram shaft for selectively extending and retracting the ram block, the ram shaft having a ram head receivable in the receptacle, the ram head having least one shaft groove corresponding to the at least one block groove;

a ram connector for operatively connecting the ram head to the ram block in the receptacle, the ram connector comprising at least one shear connector disposable through a surface of the ram block and the receptacle, the ram connector correspondingly receivable in the at least one block groove and the at least one shaft groove whereby the ram shaft is releasably securable to the ram block; and at least one actuator for selectively activating the at least one ram assembly.

24. The blowout preventer of claim 23, further comprising a controller.

25. The blowout preventer of claim 23, further comprising a remote operated vehicle.

* * * * *